US010399365B2

(12) United States Patent
Ihara et al.

(10) Patent No.: US 10,399,365 B2
(45) Date of Patent: Sep. 3, 2019

(54) LIQUID EJECTING APPARATUS

(71) Applicant: SEIKO EPSON CORPORATION, Tokyo (JP)

(72) Inventors: Seiji Ihara, Azumino (JP); Kenji Otokita, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/921,122

(22) Filed: Mar. 14, 2018

(65) Prior Publication Data

US 2019/0168521 A1 Jun. 6, 2019

(30) Foreign Application Priority Data

Mar. 24, 2017 (JP) ..... 2017-058632

(51) Int. Cl.
*B41J 13/00* (2006.01)
*B41J 25/308* (2006.01)

(52) U.S. Cl.
CPC ..... *B41J 13/0009* (2013.01); *B41J 25/308* (2013.01)

(58) Field of Classification Search
CPC ..... B41J 13/0009; B41J 25/308
See application file for complete search history.

(56) References Cited

U.S. PATENT DOCUMENTS

2017/0341373 A1* 11/2017 Kato ..... B41J 2/04505

FOREIGN PATENT DOCUMENTS

JP 2013-035184 A 2/2013

* cited by examiner

*Primary Examiner* — Bradley W Thies
(74) *Attorney, Agent, or Firm* — Workman Nydegger

(57) ABSTRACT

A detection plate portion detects an object that can come into contact with a liquid ejecting unit, which ejects a liquid onto a medium, in accordance with relative movement between the liquid ejecting unit and the medium, is formed in a plate shape, and undergoes strain upon contact with the medium. An electric signal corresponding to the strain of the detection plate portion is obtained from a piezoelectric film sensor provided on a medium-side plate surface of the detection plate portion facing the medium. A sensor cover is provided apart from the detection plate portion, and the sensor cover covers the piezoelectric film sensor not to come into contact with the medium-side plate surface.

6 Claims, 10 Drawing Sheets

| SENSOR COVER SHAPE / LOAD [N] |   |   |
|---|---|---|
| 0.2 | 0.0274 | 0.0600 |
| 2.0 | 0.2742 | 0.5998 |
| 20.0 | 2.7415 | 5.9983 |
| | VERTICAL DISPLACEMENT [mm] | |

LIQUID EJECTING APPARATUS

BACKGROUND

1. Technical Field

The present invention relates to a liquid ejecting apparatus.

2. Related Art

To date, a liquid ejecting apparatus that ejects a liquid such as ink onto a medium being transported has been used. In such a liquid ejecting apparatus, the medium may rise up during the transportation process or a foreign object may adhere to the surface of the medium. In the case where the risen medium itself or the foreign object on the surface of the medium comes into contact with a liquid ejecting unit, at least one of the medium and the liquid ejecting unit may become damaged. Accordingly, various techniques have been disclosed for reducing the likelihood of a medium, a foreign object, or the like coming into contact with a liquid ejecting unit.

For example, JP-A-2013-35184 discloses a liquid ejecting apparatus (ink jet recording apparatus) that detects rising of a medium by an optical detection device in order to reduce the likelihood of a medium and a liquid ejecting unit coming into contact with each other. Whether or not there is a foreign object on the surface of the medium can also be detected by the optical detection device proposed in JP-A-2013-35184.

However, while the optical detection mechanism disclosed in JP-A-2013-35184 can detect a foreign object with high accuracy, it is necessary to perform highly accurate equipment adjustment such as optical axis adjustment between a light projecting portion on one end side of the medium and a light receiving portion on the other end side of the medium. In addition, various electrical control devices are required for oscillation control of laser light.

SUMMARY

An advantage of some aspects of the invention is that a foreign object detection device which can achieve high accuracy of foreign object detection as much as an optical detection device and which can simplify the adjustment of equipment is provided.

An advantage of some aspects of the invention can be realized as the following application examples.

(1) There is provided a liquid ejecting apparatus according to an aspect of the invention. This liquid ejecting apparatus includes: a supporting member that supports a medium; a liquid ejecting unit that is arranged to face the medium and that ejects a liquid onto the medium; a detection plate portion that is plate shaped and that undergoes strain by coming into contact with an object that can come into contact with the liquid ejecting unit with relative movement between the medium and the liquid ejecting unit; a piezoelectric film sensor that is provided on a medium-side plate surface of the detection plate portion facing the medium and that outputs an electric signal corresponding to strain of the detection plate portion; and a sensor cover that is spaced apart from the detection plate portion and that covers the piezoelectric film sensor not to come into contact with the medium-side plate surface. The piezoelectric film sensor is positioned between the sensor cover and the liquid ejecting unit in a direction of the relative movement and the sensor cover is positioned between the supporting member and the piezoelectric film sensor in a direction in which the sensor cover faces the supporting member.

The liquid ejecting apparatus according to this aspect detects a foreign object adhering to the medium surface or a curved medium as follows. If a foreign object is attached to the surface of the medium or the medium itself is curved, the detection plate portion that is plate shaped comes into contact with the foreign object or the curved medium, and the detection plate portion consequently becomes distorted. The strain of the detection plate portion is detected with high sensitivity by the piezoelectric film sensor capable of detecting extremely small strain. Moreover, even though the object such as a foreign object or a curved medium comes into contact with the sensor cover, it is difficult for the object to contact the piezoelectric film sensor covered by the sensor cover. As a result, in the liquid ejecting apparatus according to this aspect, in addition to enabling accurate foreign object detection, it is possible to protect the piezoelectric film sensor that provides highly accurate foreign object detection. In addition, after the piezoelectric film sensor has been provided on the detection plate portion, because adjustment of the sensor position or the like is not necessary, neither unique device adjustment nor an electrical control device is necessary. As a result, in the liquid ejecting apparatus according to this aspect, it is possible to simplify the mechanical adjustment of the mechanical device while improving the accuracy of detection of a foreign object.

(2) In the liquid ejecting apparatus according to the above-described aspect, the sensor cover may be elastically deformed when a force, which is smaller than the minimum force for deformation of a surface constituting member of the supporting member when a force is applied to the surface constituting member, is applied to the sensor cover and, as the sensor cover is elastically deformed, a edge of the sensor cover comes into contact with the detection plate portion. With this structure, there are the following two advantages. Firstly, when an object comes into contact with the sensor cover and the surface constituting member of the supporting member, because the sensor cover is elastically deformed prior to the surface constituting member of the supporting member, damage such as a dent caused by entrance of the object between the supporting member and the sensor cover can be prevented from occurring on the surface of the supporting member. Secondly, owing to the positional relationship between the sensor cover and the piezoelectric film sensor, because the sensor cover is separated from the detection plate portion on the upstream side of the liquid ejecting unit in the medium movement direction of the medium, the object comes into contact with the sensor cover before the detection plate portion. The sensor cover in contact with the object in this way is elastically deformed, comes into contact with the detection plate portion, and induces strain of the detection plate portion. By this strain induction, the piezoelectric film sensor outputs an electric signal corresponding to the strain of the detection plate portion before the object reaches the detection plate portion. As a result, in this case of the liquid ejecting apparatus, it is possible to detect a foreign object at an early stage while improving the accuracy of detection of the foreign object.

(3) In the liquid ejecting apparatus according to the above-described aspect, the sensor cover may be configured in such a manner that, in the case where a surface constituting member of the supporting member is made of a material exhibiting a yielding behavior, the sensor cover deforms with a weaker force than a yield stress of the surface constituting member of the supporting member and, along with the deformation, a edge of the sensor cover comes into contact with the detection plate portion, and, in the case where the surface constituting member of the supporting member is made of a material exhibiting no yielding behavior, the sensor cover deforms with a weaker force than a 0.2% proof stress of the surface constituting member of the supporting member, and, along with the deformation, the edge of the sensor cover comes into contact with the detection plate portion. With this structure, when an object comes into contact with the sensor cover and the surface constituting member of the supporting member, because the sensor cover deforms prior to the surface constituting member of the supporting member, damage such as a dent caused by entrance of the object between the supporting member and the sensor cover can be prevented from occurring on the surface of the supporting member.

(4) In the liquid ejecting apparatus according to the above-described aspect, the sensor cover may be configured in such a manner that in the case where the sensor cover is deformed upon contact with an object, the sensor cover comes into contact with the medium-side plate surface in a region other than the region where the piezoelectric film sensor is disposed, and induces strain of the detection plate portion. With this structure, there are the following advantages. Because the sensor cover is separated from the detection plate portion on the upstream side of the liquid ejecting unit in the medium movement direction of the medium, the object comes into contact with the sensor cover before the detection plate portion. In this way, because the sensor cover in contact with the object deforms and induces strain of the detection plate portion, the piezoelectric film sensor outputs an electric signal corresponding to the strain of the detection plate portion before the object reaches the detection plate portion. As a result, in this case of the liquid ejecting apparatus, it is possible to detect a foreign object at an early stage while improving the accuracy of detection of the foreign object. In addition, because the sensor cover deformed through contact with the foreign object does not interfere with the piezoelectric film sensor, the sensor cover does not damage the piezoelectric film sensor.

(5) In the liquid ejecting apparatus according to the above-described aspect, the sensor cover may be configured in such a manner that the sensor cover does not undergo plastic deformation with the minimum force that induces strain in the detection plate portion. With this structure, because unexpected plastic deformation of the sensor cover can be avoided, it is possible to ensure the effectiveness of protection of the piezoelectric film sensor and the effect of inducing strain on the detection plate portion when in contact with an object.

(6) In the liquid ejecting apparatus according to the above-described aspect, the sensor cover may be formed of a conductive material and grounded. With this structure, the influence of static electricity on the piezoelectric film sensor can be eliminated or suppressed.

In addition, the invention can be realized in various embodiments, for example, it can be realized in the form of an image forming apparatus, a printing apparatus, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
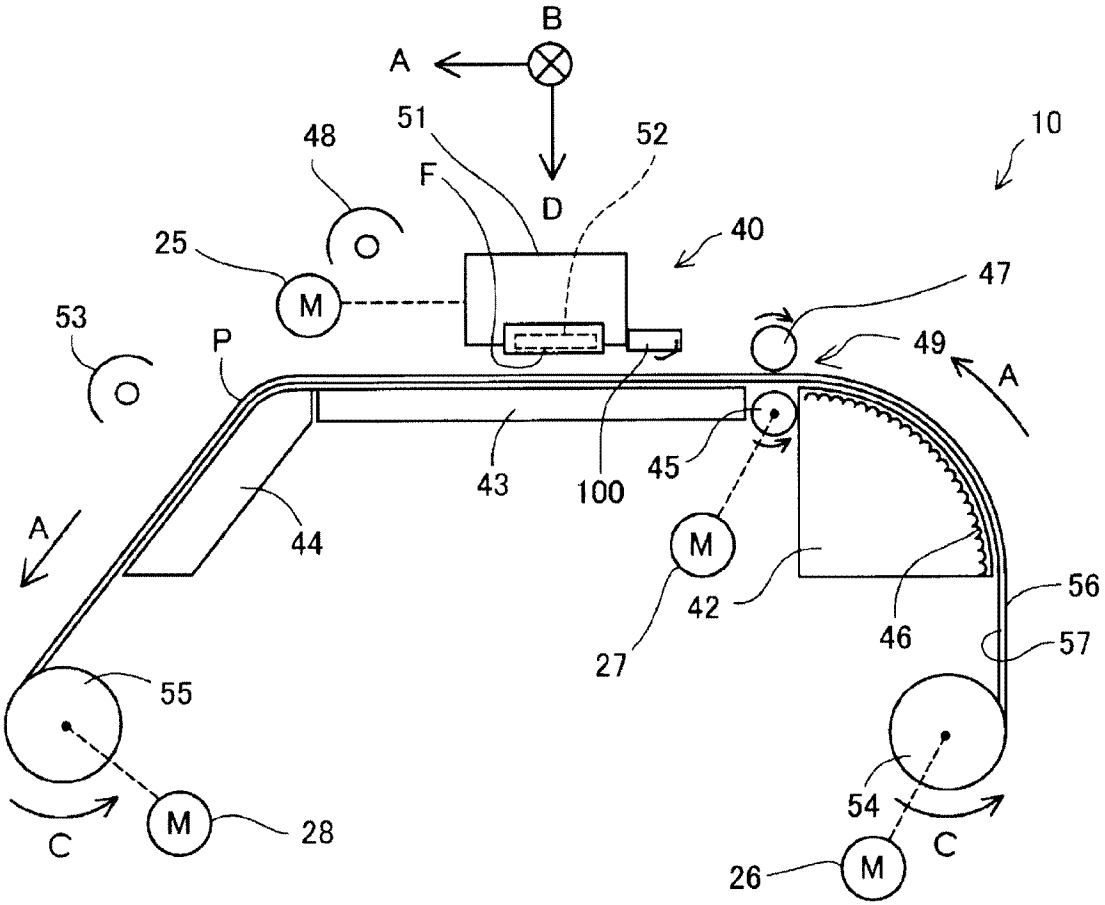
FIG. 1 is a schematic side view illustrating a schematic configuration of a recording apparatus having a liquid ejecting apparatus according to an embodiment of the invention.
Figure 2:
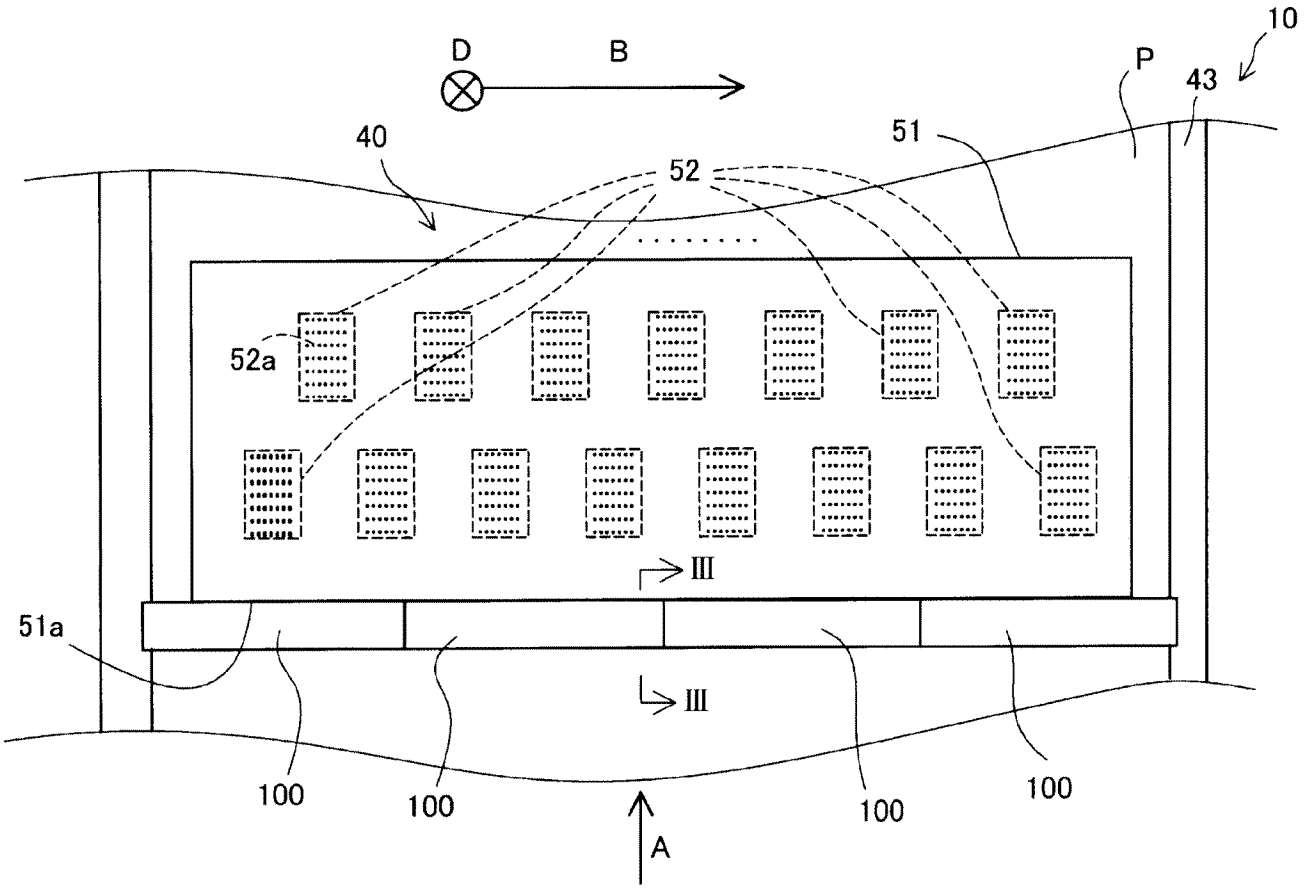
FIG. 2 is a schematic plan view schematically illustrating a peripheral configuration of a carriage included in the liquid ejecting apparatus in plan view.

FIG. 1 is a schematic side view illustrating a schematic configuration of a recording apparatus 10 having a liquid ejecting apparatus 40 according to an embodiment of the invention. FIG. 2 is a schematic plan view schematically illustrating a peripheral configuration of a carriage 51 included in the liquid ejecting apparatus 40 in plan view.

The recording apparatus 10 includes a transport section 49 that transports a medium P and the liquid ejecting apparatus 40 that ejects ink to the medium P. First, the transport section 49 will be described. As illustrated in FIG. 1, the transport section 49 includes a setting unit 54 that feeds out the medium P, a winding unit 55 that winds the medium P, and transport rollers 45 and 47 that transport the medium P. The setting unit 54, the transport rollers 45 and 47, and the winding unit 55 are driven by a feed-out motor 26, a transport motor 27, and a winding motor 28, respectively. In addition, platens 42, 43, and 44, which are supporting members for supporting the medium P, are provided along a transport path from the setting unit 54 to the winding unit 55. Therefore, by driving the setting unit 54, the transport rollers 45 and 47 and the winding unit 55, the medium P is transported along the platens 42, 43, and 44. The platen 43 is formed as a flat platen that transports the medium P substantially horizontally. The ejection of ink toward the medium P by the liquid ejecting apparatus 40 is performed at the position of the platen 43, that is, at a position where the medium P is kept horizontal.

The transport direction of the medium P from the setting unit 54 to the winding unit 55 is referred to as a transport direction A. In addition, the width direction (the paper plane direction in FIG. 1) of the medium P is referred to as an intersecting direction B. The direction intersecting the transport direction A and the intersecting direction B is referred to as an ejection direction D. In the other drawings as well, the directions A, B, and D are appropriately illustrated.

Because the medium P is to be transported in the transport direction A with winding performed by the winding unit 55, the winding unit 55, the transport roller 45, and the setting unit 54 are rotated in a direction C illustrated in the drawing. Three heaters 46, 48, and 53 for heating the medium P are provided along the transport path from the setting unit 54 to the winding unit 55. The heater 46 is an infrared-radiation-type heater provided in the platen 42, and heats the medium P from the rear surface. Because the medium P is heated before the liquid is ejected by the liquid ejecting apparatus 40, this heating is also referred to as preheating. The heater 48 is provided at a position on the downstream side of the platen 43 in the transport direction so as to face the platen 43 with the medium P interposed therebetween. This heater 48 is also of the infrared radiation type, and dries the ink immediately after the ink has been discharged onto the medium P by the liquid ejecting apparatus 40. The heater 53 is provided at a position opposed to the platen 44 with the medium P interposed therebetween. The heater 53 is for firmly fixing to the medium P the ink ejected onto the medium P by the liquid ejecting apparatus 40. Further, these heaters 46, 48, and 53 are not limited to the infrared radiation type, and any type of heater may be adopted as long as it can dry the medium P or the ink on the medium P, such as a type that blows warm air.

Next, the liquid ejecting apparatus 40 will be described. The liquid ejecting apparatus 40 includes a recording head 52, the carriage 51 that moves the recording head 52 relative to the medium P, and a detection unit 100 that detects a foreign object or the like on the medium P. The carriage 51 can move in the transport direction A relative to the medium P by a mechanism (not illustrated) using a carriage motor 25 as a driving source. The recording head 52 and the detection unit 100 are provided in a plurality along the intersecting direction B in FIG. 1. This situation is illustrated in FIG. 2.

As illustrated in FIG. 2, on the carriage 51, fifteen of the recording heads 52 are alternately arranged along the intersecting direction B. The recording heads 52 correspond to the liquid ejecting unit of the invention. In each of the recording heads 52, nozzle rows 52*a* in which nozzles that eject ink droplets are arranged along the intersecting direction B are provided in a number corresponding to the number of types of ink. Even though the seven of the recording heads 52 and the eight of the recording heads 52 are arranged apart from each other by a predetermined distance in the transport direction A, when attention is focused on the nozzle rows 52*a* for one ink, the nozzle rows 52*a* provided in the fifteen of the recording heads 52 have nozzle pitches at equal intervals. That is, the recording heads 52 provided on the carriage 51 are configured as a line head that covers substantially the entire region in the width direction of the medium P. Further, other types of recording heads may be used as the recording heads 52 such as, a serial head for which a carriage, which has a length in the intersecting direction B shorter than that of the carriage 51 illustrated in FIG. 2 and in which a smaller number of the recording heads 52 than the ones illustrated in FIG. 2 are arranged alternately along the intersecting direction B, reciprocates in the transport direction A, a serial head in which the nozzle rows are arranged in the transport direction A and for which the carriage 51 reciprocates in the width direction of the medium P, or the like.

Detection units 100 are provided upstream of the position, where the fifteen of the recording heads 52 are provided, in the transport direction A, that is, at an end portion 51*a* of the carriage 51. In this embodiment, four of the detection units 100 are used in the intersecting direction B. In this embodiment, the width from one end to the other end of the four detection units 100 along the intersecting direction B (hereinafter referred to as the total combined length of the detection units 100) is substantially the same as the width of the medium P. Note that the detection units 100 may have a total combined length smaller than the width of the medium P and the carriage 51 may be moved in the intersecting direction B while repeating the detection operation to be described later. Such a detection operation will be described in detail later.

Figure 3:
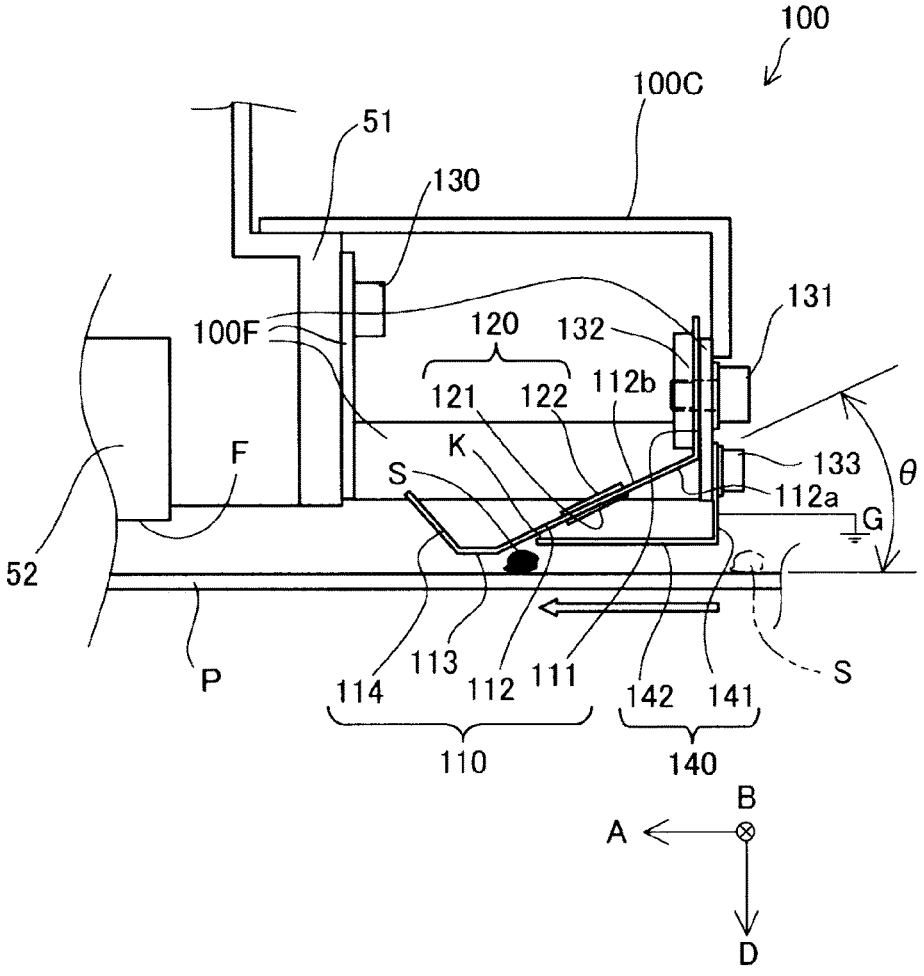
FIG. 3 is an explanatory view illustrating a configuration of a detection unit by sectioning the detection unit along line III-III of FIG. 2.
Figure 4:
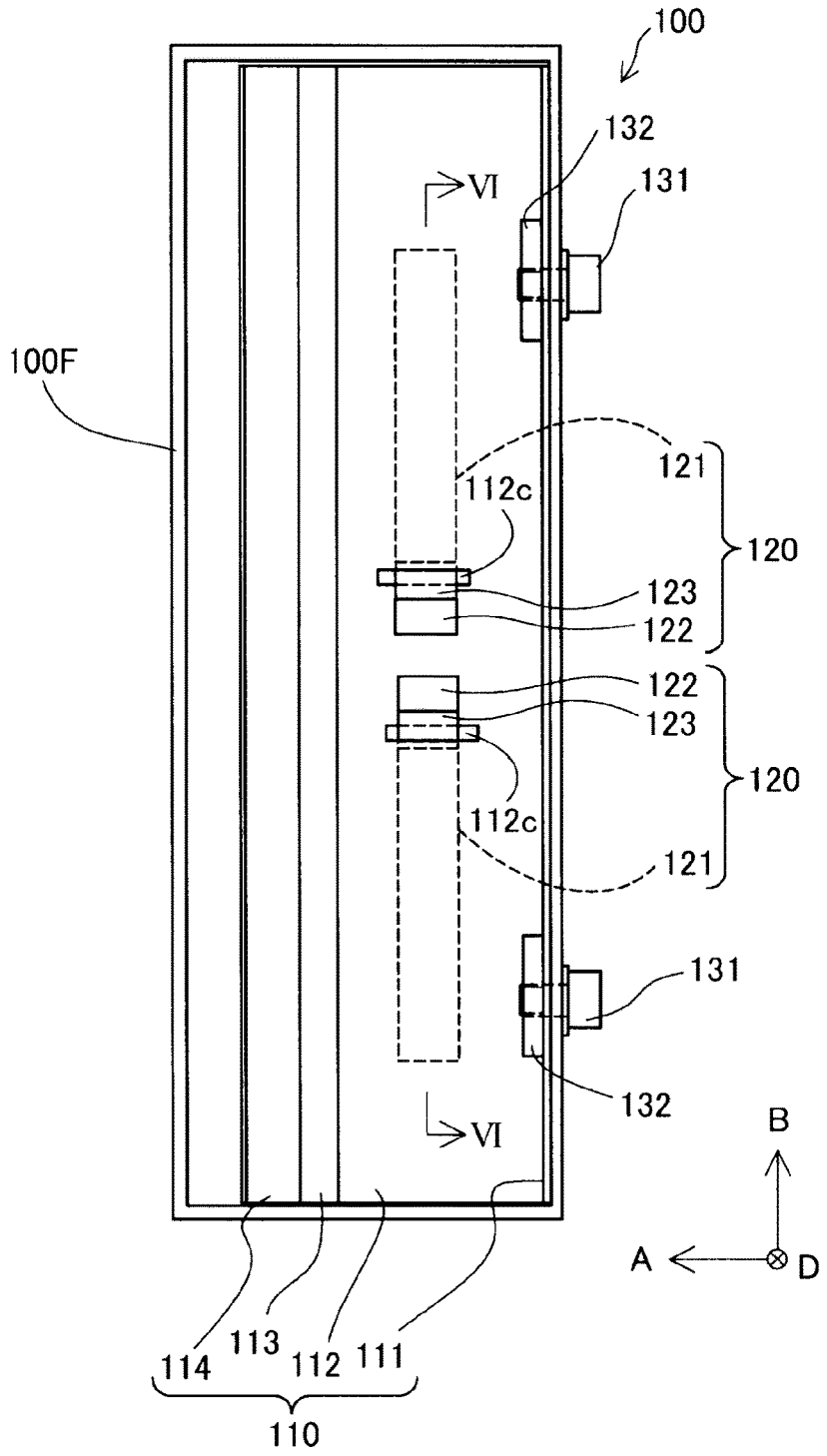
FIG. 4 is an explanatory view illustrating a configuration of the detection unit in a plan view of the detection unit in an ejection direction.
Figure 5:
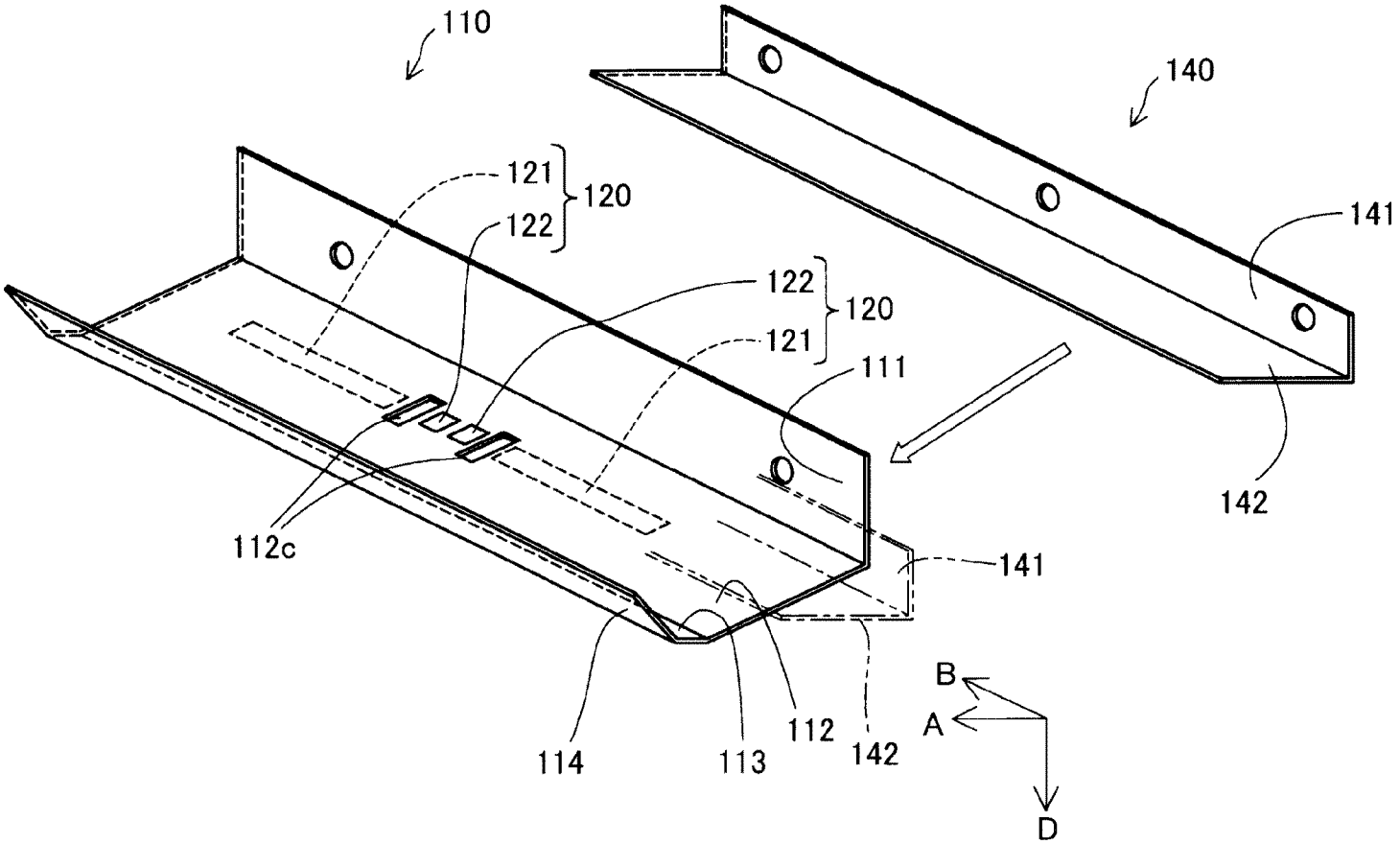
FIG. 5 is an explanatory view illustrating the outline of a foreign object detection plate included in the detection unit together with a sensor cover in a perspective view.
Figure 6:
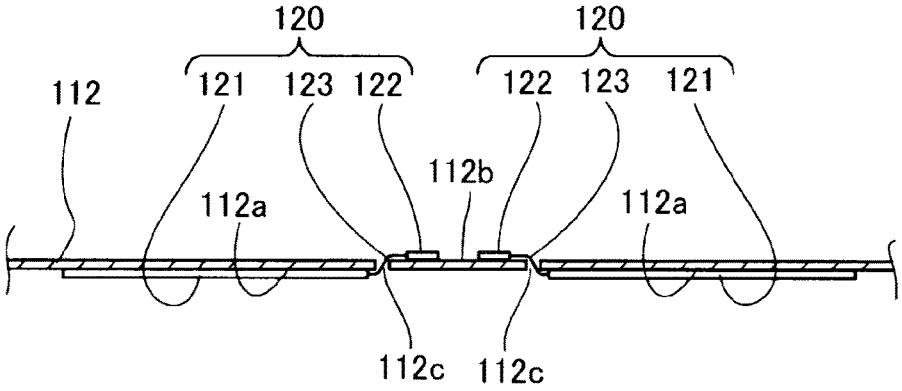
FIG. 6 is an explanatory view illustrating the disposition of a piezoelectric film sensor taken along a line VI-VI in FIG. 4.

Next, the configuration of the detection unit 100 will be described. FIG. 3 is an explanatory view illustrating the configuration of the detection unit 100 by sectioning the detection unit 100 along line III-III of FIG. 2. FIG. 4 is an explanatory view illustrating the configuration of the detection unit 100 in plan view of the detection unit 100 in the ejection direction D. FIG. 5 is an explanatory view illustrating the outline of a foreign object detection plate 110 included in the detection unit 100 together with a sensor cover 140 in a perspective view. FIG. 6 is an explanatory view illustrating the disposition of piezoelectric film sensors 120 taken along a line VI-VI in FIG. 4. Further, in FIG. 3, in order to ensure visibility, hatching that indicates a member cross section has been omitted.

As illustrated in FIG. 4, the detection unit 100 includes the foreign object detection plate 110 surrounded by a frame 100F, and the piezoelectric film sensors 120 are provided on the foreign object detection plate 110. As illustrated in FIG. 3, the frame 100F is fixed to the carriage 51 by bolts 130 and holds the foreign object detection plate 110 upstream of the recording heads 52 in the transport direction A while surrounding the foreign object detection plate 110.

In the detection unit 100, an upper cover 100C is fixed to the upper end of the frame 100F with a bolt (not illustrated) to protect the foreign object detection plate 110 from the upper surface side of the plate. In addition, in the detection unit 100, the sensor cover 140 is fixed to the lower end of the frame 100F with bolts 133, and the foreign object detection plate 110 is protected from the lower surface side of the plate. The upper cover 100C and the sensor cover 140 are provided for each of the detection units, and by arranging the four of the detection units 100 in line, the foreign object detection plate 110 is protected from the upper and lower surface sides over the entire region in the intersecting direction B. The sensor cover 140 will be described later in relation to the configuration of the foreign object detection plate 110.

The foreign object detection plate 110 is a single plate material and corresponds to a detection plate portion that detects the presence of a foreign object that may come into contact with a nozzle forming surface F of the recording head 52 with movement of the recording head 52 or transportation of the medium P, wrinkles, folds, or tears formed on the medium P, or the medium P itself which has risen. In FIG. 3, these objects are depicted as a foreign object S. Detection of a foreign object will be described later.

The foreign object detection plate 110 for detecting a foreign object includes a first plate portion 111, a second plate portion 112, a third plate portion 113, and a fourth plate portion 114 that are continuous with one another. In this embodiment, in order to ensure rigidity for shape maintenance and reliable strain induction upon detection of a foreign object (to be described later), the foreign object detection plate 110 is a plate material shaped and formed by subjecting a stainless steel plate of about 0.2 to 0.5 mm to press forming. Further, the foreign object detection plate 110 may be formed of a plate material such as aluminum or titanium. In addition, engineering plastics such as polyamide, polycarbonate or the like which can secure rigidity and induce reliable strain may be used as the foreign object detection plate 110, or these plastics may be formed as an integral molded article or the like.

The first plate portion 111 is fixed to the frame 100F over the entire surface thereof with bolts 131 and nuts 132, and holds the second plate portion 112 and the third plate portion 113, which are continuous, in a cantilever shape. Here, note that the cantilever shape refers to a state in which the foreign object detection plate 110 is fixed to the frame 100F only at one end portion (the first plate portion 111 in FIG. 4) of the foreign object detection plate 110 in a direction intersecting the extending direction of the nozzle rows (the transport direction A in FIG. 4), and the other end is not fixed but is a free end. In addition, the first plate portion 111 is fixed to the carriage 51 via the frame 100F at a position separated from the recording head 52 housed in the carriage 51.

The second plate portion 112 is a mounting target portion of the piezoelectric film sensor 120, which will be described later, and has an opening portion 112*c*. The second plate portion 112 is bent and continuous from the first plate portion 111 toward the recording head 52 and is arranged diagonal to the medium P. A formed angle θ (refer to FIG. 3) between the second plate portion 112 and the medium P is 25°. In this case, the formed angle θ between the second plate portion 112 and the medium P is not limited as long as it is 30° or less, and is determined depending on the size of the detection unit 100 along the transport direction A, the minimum size of the foreign object to be detected, required detection sensitivity, and the like.

The third plate portion 113 is bent and continuous from the second plate portion 112 and faces the medium P leaving a gap between the third plate portion 113 and the medium P. More specifically, the third plate portion 113 is a plate portion parallel to the medium P, and has a width of 3 mm along the transport direction A. The gap with the medium P is specified in accordance with the size of the smallest foreign object to be detected; in the embodiment, the foreign object detection plate 110 is fixed to the frame 100F at the first plate portion 111 in such a manner that the gap between the third plate portion 113 and the medium P is set to 0.5 to 2.0 mm. The fourth plate portion 114 is bent from and continuous with the third plate portion 113 and is bent toward a side away from the medium P.

Two of the piezoelectric film sensors 120 are provided on the above-mentioned second plate portion 112, and each of the piezoelectric film sensors 120 includes a detection film portion 121 and an output circuit unit 122, which are connected to each other by plate wiring 123. The detection film portion 121 is formed in a rectangular shape and includes a piezoelectric element which causes a voltage change corresponding to the strain of the second plate portion 112 and outputs the voltage change of the piezoelectric element to the output circuit unit 122 via the plate wiring 123. The output circuit unit 122 converts the voltage change of the detection film portion 121 into an electric signal corresponding to the strain of the second plate portion 112 and outputs the electric signal. The detection film portion 121 of the piezoelectric film sensor 120 of this embodiment has a voltage change characteristic causing a voltage change to the plus side when a tensile force is applied and is mounted on a first plate surface 112*a* of the second plate portion 112 facing the medium P by adhering the detection film portion 121 thereto with an appropriate adhesive. This first plate surface 112*a* corresponds to a medium-side plate surface in the invention. The output circuit unit 122 of the piezoelectric film sensor 120 is mounted on a second plate surface 112*b* on the rear side of the first plate surface 112*a* of the second plate portion 112 by adhering the output circuit unit 122 thereto with a suitable adhesive. The detection film portion 121 on the first plate surface 112*a* is electrically connected through the opening portion 112*c* formed in the second plate portion 112 to the output circuit unit 122 on the second plate surface 112*b* via the plate wiring 123. Further, in FIG. 5, illustration of the plate wiring 123 is omitted.

As illustrated in FIGS. 4 to 6, the foreign object detection plate 110 has two of the piezoelectric film sensors 120 described above provided on the second plate portion 112 along the intersecting direction B. Each of detection film portions 121 of the piezoelectric film sensors 120 is mounted on the first plate surface 112*a* of the second plate portion 112 so that the longitudinal direction thereof is along the width direction of the medium P, that is, along the intersecting direction B in the drawing. The piezoelectric film sensors 120 output an electric signal corresponding to the strain occurring in the second plate portion 112 to a control unit 18 to be described later via the output circuit unit 122. The strain of the second plate portion 112 occurs when a foreign object S illustrated in FIG. 3 comes into contact with the foreign object detection plate 110, specifically the second plate portion 112 or the third plate portion 113, and consequently the piezoelectric film sensors 120 output an electric signal at the time of contact with the foreign object. Because each of the piezoelectric film sensors 120 has a sensor configuration in which piezoelectric elements are disposed in a film form, the piezoelectric film sensor 120 detects a slight strain of the second plate portion 112 as a displacement, and then outputs an electric signal corresponding to the slight strain of the second plate portion 112.

The sensor cover 140 is a single plate material, and includes, in a continuous manner, a fixed plate portion 141 fixed to the frame 100F and a cover plate portion 142 that extends substantially parallel to the medium P and that is bent substantially at 90° to the fixed plate portion 141. The sensor cover 140 fixed to the frame 100F via the fixed plate portion 141 is positioned on the upstream side of the recording head 52 in the medium movement direction in which the medium P moves, that is, in the transport direction A of the medium P, and is separated from the second plate portion 112 of the foreign object detection plate 110. That is, as illustrated in FIG. 3, in the sensor cover 140, the edge of the cover plate portion 142 is made not to come into contact with the first plate surface 112*a* of the second plate portion 112, and the cover plate portion 142 and the fixed plate portion 141 cover the piezoelectric film sensors 120. As illustrated in FIG. 5, because the sensor cover 140 has substantially the same length as the foreign object detection plate 110 in the intersecting direction B, the sensor cover 140 covers the entire area of the piezoelectric film sensors 120. The cover plate portion 142 covers the piezoelectric film sensors 120 on the side of the medium P, and the edge thereof in the transport direction A is deviated from the installation region of the piezoelectric film sensors 120 toward the side of the third plate portion 113, that is, to a region other than the region where the piezoelectric film sensors 120 are disposed, and does not interfere with the piezoelectric film sensors 120. In this embodiment, the cover plate portion 142 is bent from the fixed plate portion 141 so as to be substantially parallel to the medium P, and a non-interference area K is left between the edge of the cover plate portion 142 and the first plate surface 112*a* of the second plate portion 112, and the gap with the medium P is set to 3.0 to 4.0 mm. This gap is wider than the gap (0.5 to 2.0 mm) between the third plate portion 113 and the medium P.

In this embodiment, in order to secure rigidity for shape maintenance and reliable strain induction upon detection of a foreign object (to be described later), the sensor cover 140, like the foreign object detection plate 110, is a plate material shaped and formed by subjecting a stainless steel plate of about 0.2 to 0.5 mm to press forming. By defining such a material and thickness, in this embodiment, the sensor cover 140 is a plate material, deforms with a weaker force than the 0.2% proof stress of a platen mesh material serving as the surface constituting member of the platen 43 illustrated in FIG. 1, and comes into contact with the second plate portion 112 at the edge of the sensor cover 140 in accordance with the deformation. The 0.2% proof stress mentioned here is the stress used in a dynamic system in place of the yield stress. Because the sensor cover 140 is made of the same material and has the same thickness as the foreign object detection plate 110, plastic deformation does not occur with the minimum force that induces strain in the foreign object detection plate 110, specifically the second plate portion 112. In addition, the sensor cover 140 is made of stainless steel, which is a conductive material, and is grounded. In FIG. 3, although grounding is schematically illustrated by the earth wire, the sensor cover 140 may be grounded via the frame 100F or the like to which the sensor cover 140 is fixed.

Figure 7:
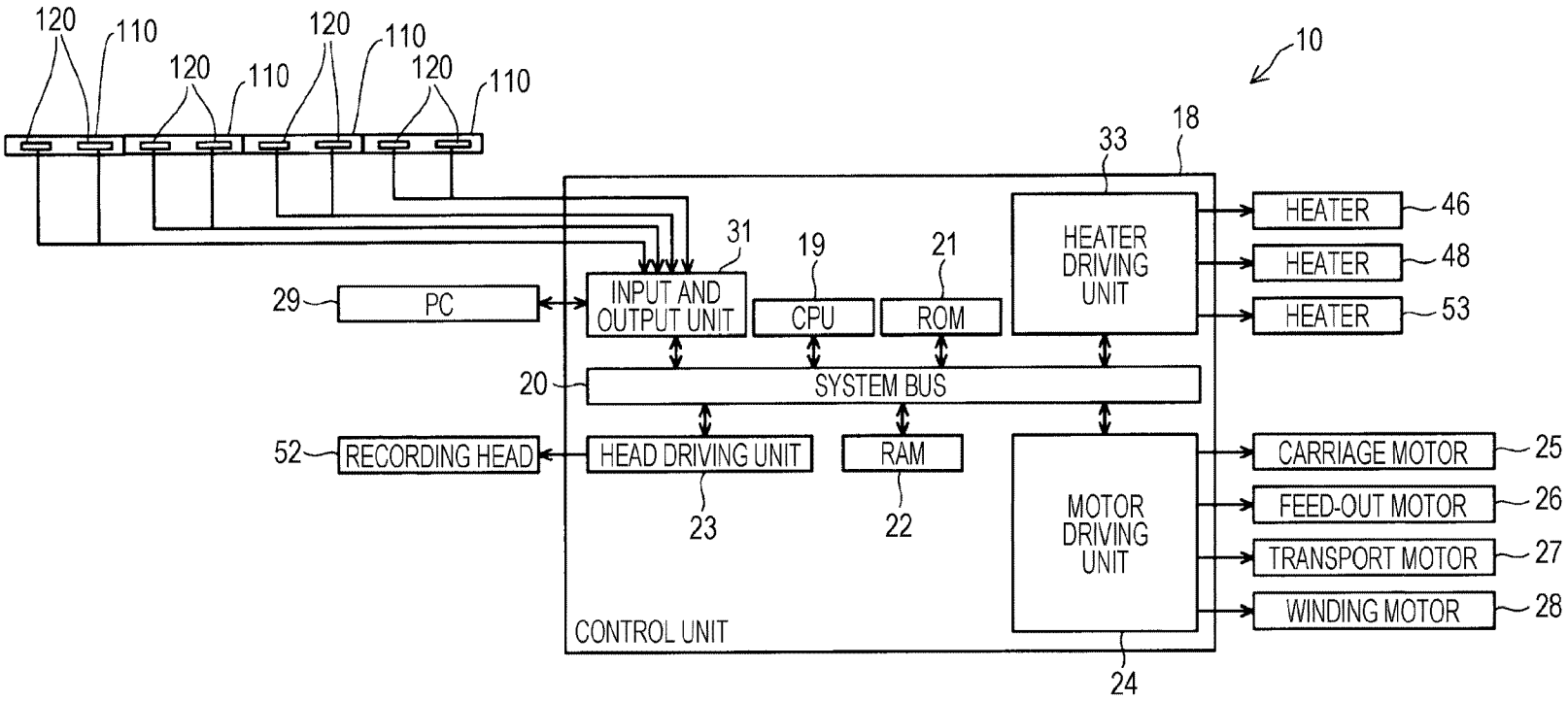
FIG. 7 is a block diagram illustrating an electrical configuration of a recording apparatus according to an embodiment.

Next, the electrical configuration of the recording apparatus 10 of the embodiment will be described. FIG. 7 is a block diagram illustrating an electrical configuration of the recording apparatus 10 according to the embodiment. A CPU 19 controlling the entirety of the recording apparatus 10 is provided in the control unit 18. The CPU 19 is connected, via a system bus 20, to a ROM 21 that stores individual control programs and the like that the CPU 19 performs and a RAM 22 that is capable of temporarily storing data.

The CPU 19 is connected, via the system bus 20, to a head driving unit 23 that drives the recording heads 52. In addition, the CPU 19 is connected, via the system bus 20, to a motor driving unit 24. The motor driving unit 24 is connected to and drives the motors of the carriage motor 25, which moves the carriage 51, the feed-out motor 26, which is a drive source for the setting unit 54, the transport motor 27, which is a drive source for the transport roller 45, and the winding motor 28, which is a drive source for the winding unit 55. In addition, the CPU 19 is connected, via the system bus 20, to a heater driving unit 33 that drives the heater 46, the heater 48, and the heater 53. Furthermore, the CPU 19 is connected to an input and output unit 31 via the system bus 20, and the input and output unit 31 is connected to the two of the piezoelectric film sensors 120 of each of the foreign object detection plates 110, and a PC 29, which is an external device for inputting recording data and the like to the recording apparatus 10. Further, note that the PC 29 need not be an external device but may be one of the components of the recording apparatus 10.

In the case where the piezoelectric film sensors 120 output an electric signal associated with the strain of the second plate portion 112, the liquid ejecting apparatus 40 according to this embodiment, under the control of the control unit 18, stops ejection of ink by the recording heads 52 provided in the carriage 51 and stops relative movement between the medium P and the recording heads 52. Further, in the case where the piezoelectric film sensors 120 output an electric signal associated with the strain of the second plate portion 112, a message to the effect that a foreign object has been detected may be displayed on a display unit, or notification may be made by lighting a lamp, sounding a buzzer or the like.

Figure 8:
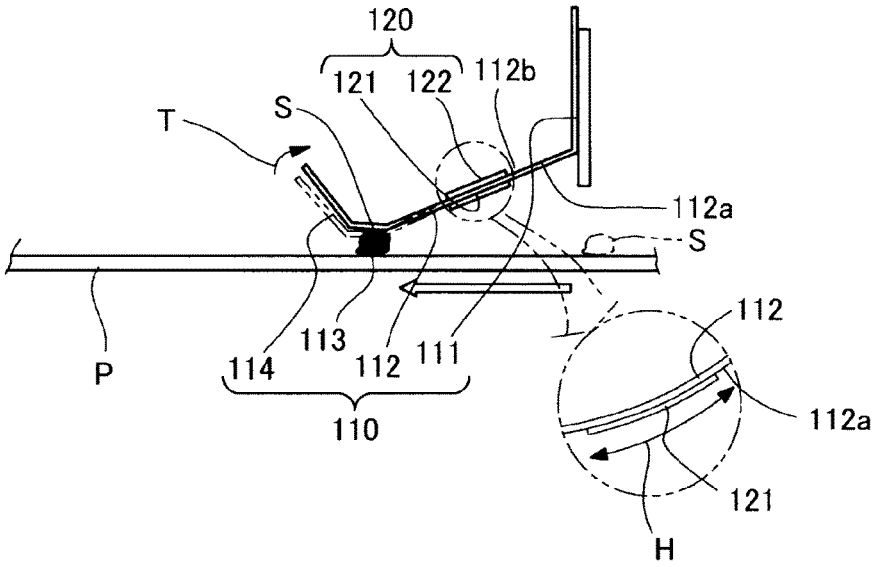
FIG. 8 is an explanatory view schematically illustrating foreign object detection by the foreign object detection plate and the piezoelectric film sensor in an enlarged manner.
Figure 9:
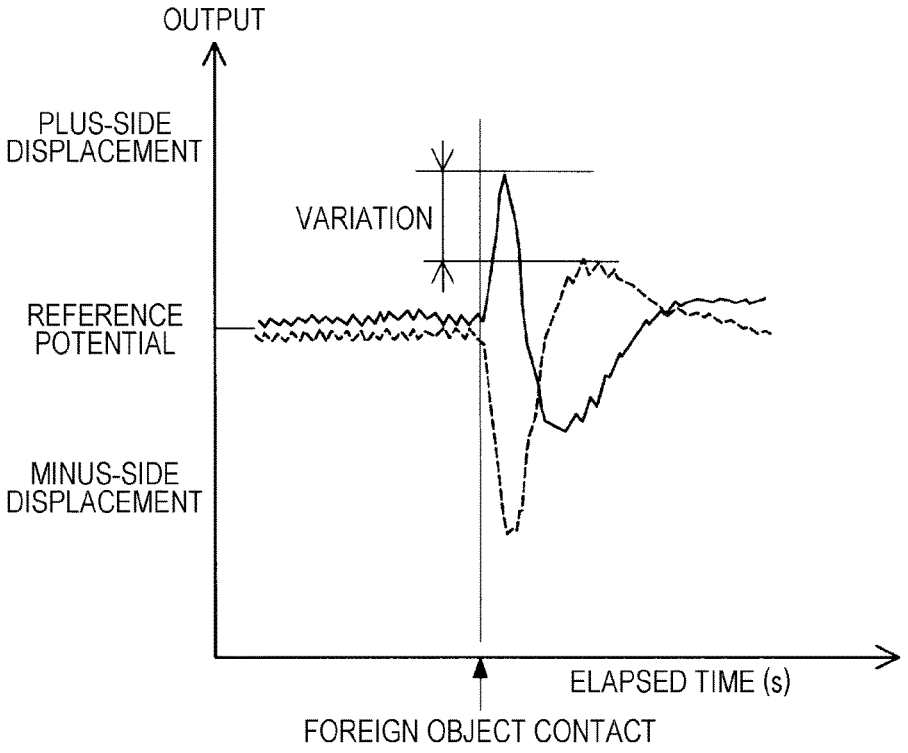
FIG. 9 is an explanatory diagram illustrating foreign object detection accuracy.

Detection of a foreign object by the liquid ejecting apparatus 40 of this embodiment described above including the size of the foreign object will be described. Firstly, detection of a small foreign object that passes between the cover plate portion 142 of the sensor cover 140 and the medium P will be described. FIG. 8 is an explanatory view schematically showing the state of foreign object detection by the foreign object detection plate 110 and the piezoelectric film sensor 120 in an enlarged manner. FIG. 9 is an explanatory diagram illustrating foreign object detection accuracy. As illustrated in FIG. 8, as the medium P is transported, after passing under the cover plate portion 142, the foreign object S on the surface of the medium P reaches the second plate portion 112 or the third plate portion 113 of the foreign object detection plate 110 and pushes up the second plate portion 112 or the third plate portion 113. Because the gap between the cover plate portion 142 and the medium P is 3.0 mm to 4.0 mm and the gap between the third plate portion 113 and the medium P is 0.5 to 2.0 mm, the size of the foreign object S pushing up the second plate portion 112 or the third plate portion 113 is 0.5 to 3.0 mm. Then, as a result of the above-described pushing up of the plate portion, the second plate portion 112 bends and deflects as shown by an arrow T centering around a fixing portion of the first plate portion 111, specifically, a vertical fixing portion with respect to the frame 100F, and consequently strain occurs in the second plate portion 112.

Because this strain occurs with the side of the first plate surface 112*a* being pulled, a tensile force acts on the detection film portion 121 mounted on the first plate surface 112*a* as indicated by arrows H. Then, the detection film portion 121 already mounted on the first plate surface 112*a* of the second plate portion 112 transmits a voltage change to the plus side to the output circuit unit 122 based on the voltage change characteristic that a voltage change to the plus side occurs when a tensile force is applied, and the output circuit unit 122 outputs an electric signal corresponding to the strain of the second plate portion 112 to the control unit 18 even if the strain is small. Because the detection film portion 121 receives a tensile force that conforms to the voltage change characteristic of the detection film portion 121, it causes a voltage change with high accuracy. More specifically, the change in the output voltage indicated by the solid line in FIG. 9 is that, in the case where the detection film portion 121, which has a voltage change characteristic causing a voltage change toward the plus side when a tensile force is applied thereto, is mounted on the first plate surface 112*a* of the second plate portion 112. The change in the output voltage indicated by the dotted line in FIG. 9 is that, in the case where the detection film portion 121, which has a voltage change characteristic causing a voltage change toward the plus side when a tensile force is applied thereto, is mounted on the second plate surface 112*b* of the second plate portion 112. From comparison of these output voltage changes, it has been found that, by mounting the detection film portion 121, which has a voltage change characteristic causing a voltage change to the plus side when a tensile force is applied thereto, on the first plate surface 112*a* where the tensile force acts upon foreign object detection, as compared with the case where the detection film portion 121, which has a voltage change characteristic causing a voltage change to the plus side when a tensile force is applied thereto, is mounted on the second plate surface 112*b* of the second plate portion 112, the displacement amount from the reference potential can be improved by about 10%.

When the control unit 18 receives an electric signal associated with the detection of a foreign object from the piezoelectric film sensor 120, the control unit 18 stops at least one of the ejection of ink by the recording head 52 and the transportation of the medium P by the transport section 49 (refer to FIG. 1). As a result, in the liquid ejecting apparatus 40 of this embodiment, even without using an optical detection device, it is possible to detect a foreign object S on the medium P with the same degree of accuracy as an optical detection device. In addition, although the foreign object S contacts the first plate surface 112*a* of the second plate portion 112, the foreign object S does not interfere with the output circuit unit 122 on the second plate surface 112*b*. Therefore, according to the liquid ejecting apparatus 40 of this embodiment, in addition to highly accurate foreign object detection, the output circuit unit 122 of the piezoelectric film sensors 120 indispensable for outputting electric signals can be protected. In addition, at the time of detection of the foreign object S on the medium P by the piezoelectric film sensors 120, which are mounted on the second plate portion 112, the foreign object S has not yet reached the recording head 52 (refer to FIG. 8). Therefore, in the liquid ejecting apparatus 40 of this embodiment, it is possible to suppress damage to the medium P or the recording head 52 caused by contact between the foreign object S and the recording head 52 with a high degree of certainty. In addition, detection of a foreign object S is made based on whether or not the value of the electric signal from the piezoelectric film sensors 120 exceeds a preset threshold value. Therefore, by adjusting the threshold value, the sensitivity of detection of a foreign object S can be adjusted.

Figure 10:
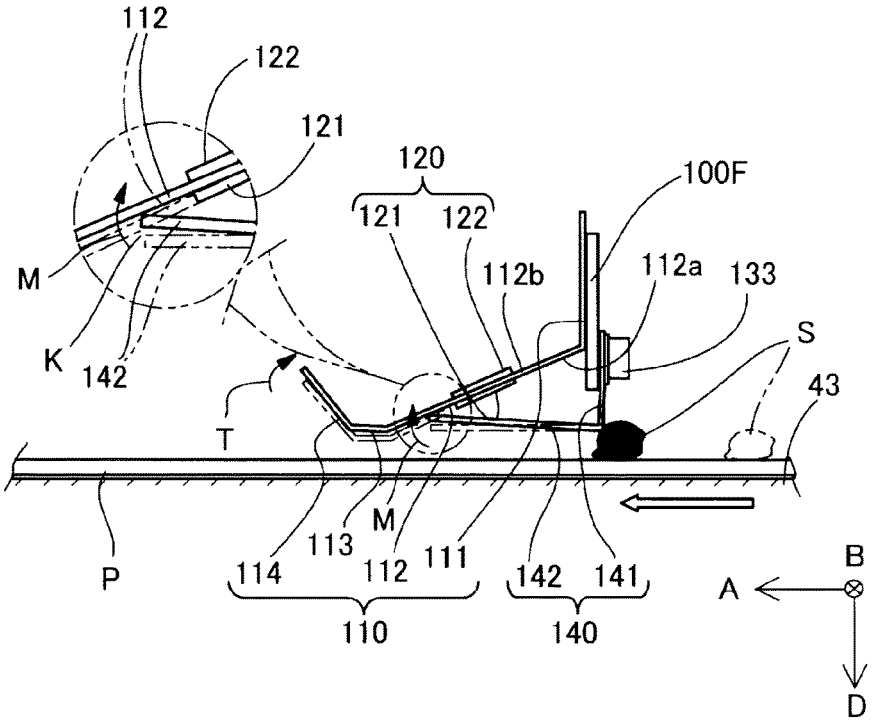
FIG. 10 is an explanatory view schematically illustrating foreign object detection and sensor protection via a sensor cover.

Next, detection of a foreign object having a size that makes contact with the sensor cover 140 as the medium P is transported will be described. FIG. 10 is an explanatory view schematically illustrating foreign object detection via the sensor cover 140 and sensor protection. Because the gap between the cover plate portion 142 and the medium P is 3.0 to 4.0 mm, the size of the foreign object S coming into contact with the sensor cover 140 along with the transport of the medium P is 3.0 mm or more. When such a foreign object S reaches the fixed plate portion 141 of the sensor cover 140 as the medium P is transported, the foreign object S pushes the fixed plate portion 141 in the transport direction A. As a result of this pushing, the cover plate portion 142 is deformed so as to rotate as indicated by an arrow M centering on the fixing portion of the fixed plate portion 141, specifically, the vertical fixing portion to the frame 100F. As a result of this deformation, the cover plate portion 142, which is not in contact with the second plate portion 112 with the non-interference region K left, contacts the second plate portion 112, and pushes up the second plate portion 112 as indicated by the arrow M. Consequently, because strain occurs in the second plate portion 112 as described above, this strain is detected by the piezoelectric film sensors 120, and at least one of the discharge of ink by the recording head 52 and the transport of the medium P by the transport section 49 (refer to FIG. 1) is stopped as described above. In addition, the contact of the foreign object S itself with the piezoelectric film sensors 120 is also prevented by the sensor cover 140. Consequently, according to the liquid ejecting apparatus 40 of this embodiment, the piezoelectric film sensors 120 that provide highly accurate foreign object detection can be more reliably protected.

In the liquid ejecting apparatus 40 of this embodiment, the sensor cover 140 is deformed by a force weaker than the 0.2% proof stress of the platen mesh material which is the surface constituting member of the platen 43 illustrated in FIG. 1, and the edge of the sensor cover 140 is a plate material that comes into contact with the second plate portion 112. Therefore, the sensor cover 140 is easily deformed by a foreign object S that has reached the fixed plate portion 141 of the sensor cover 140. Specifically, because the sensor cover 140 is deformed by a weaker force than the 0.2% proof stress and the edge of the sensor cover 140 comes into contact with the second plate portion 112 along with the deformation, the sensor cover 140 deforms in advance of the platen mesh material which is the surface constituting material of the platen 43 and the edge of the sensor cover 140 contacts the second plate portion 112, thereby detecting contact with the foreign object S. As a result, according to the liquid ejecting apparatus 40 of this embodiment, it is possible to reduce the likelihood of the surface of the platen 43 receiving damage, such as a dent, caused by a foreign object S entering between the platen 43 and the sensor cover 140. In addition, the configuration of the sensor cover 140 is not limited to this, but it is preferable to appropriately change the configuration in accordance with the material of the sensor cover 140 and the type of the surface constituting material of the platen 43. That is, any configuration may be used as long as, when a foreign object S enters between the platen 43 and the sensor cover 140, the sensor cover 140 elastically deforms with a force smaller than the minimum force required to deform the surface constituting member of the platen 43, the edge of the sensor cover 140 comes into contact with the second plate portion 112 due to elastic deformation, and a displacement of the foreign object detection plate 110 up to a point where foreign object detection can be performed is obtained.

As illustrated in FIG. 10, the liquid ejecting apparatus 40 of this embodiment is a liquid ejecting apparatus in which the sensor cover 140 deformed by contact with a foreign object S, specifically the cover plate portion 142 is brought into contact with the first plate surface 112*a* of the second plate portion 112 in a region that does not interfere with the piezoelectric film sensors 120, and strain is induced in the second plate portion 112. Therefore, it is possible to detect a foreign object at an early stage by outputting from the piezoelectric film sensors 120 an electric signal corresponding to the strain of the second plate portion 112 before the foreign object S reaches the second plate portion 112 or the third plate portion 113. Moreover, because the sensor cover 140 deformed through contact with the foreign object S does not interfere with the piezoelectric film sensors 120, damage to the piezoelectric film sensors by the sensor cover 140 that is deformed can be reliably avoided.

In the liquid ejecting apparatus 40 of this embodiment, by making the sensor cover 140 be the same as the foreign object detection plate 110 or to have the same plate thickness or material as the foreign object detection plate 110, the sensor cover 140 is configured so that plastic deformation does not occur with the minimum force required to induce strain of the second plate portion 112. Therefore, because inadvertent plastic deformation of the sensor cover 140 can be avoided, it is possible to protect the piezoelectric film sensors 120 and induce strain of the second plate portion 112 with high effectiveness when the sensor cover 140 comes into contact with a foreign object S.

In the liquid ejecting apparatus 40 of this embodiment, the sensor cover 140 is formed of stainless steel, which is a conductive material, and then grounded. Therefore, the influence of static electricity on the piezoelectric film sensors 120 covered by the sensor cover 140 can be eliminated or suppressed.

In the liquid ejecting apparatus 40 of this embodiment, in the sensor cover 140, the fixed plate portion 141 and the cover plate portion 142 are bent substantially at 90° with respect to each other. Therefore, because the pushing after the foreign object S contacts the fixed plate portion 141 easily occurs, it is easy to induce strain of the second plate portion 112 by the cover plate portion 142, and it is possible to detect a foreign object with high accuracy.

In the liquid ejecting apparatus 40 according to this embodiment, for each of the piezoelectric film sensors 120 provided on the second plate portion 112, the detection film portion 121 of the piezoelectric film sensor 120 is formed in a rectangular shape, and the detection film portion 121 is formed so that the longitudinal direction thereof is along the width direction of the medium P. Therefore, the area occupied by the detection film portion 121 along the transport direction A orthogonal to the width direction of the medium P is narrow, and the foreign object detection plate 110 having the second plate portion 112 can be decreased in size.

In the liquid ejecting apparatus 40 according to this embodiment, the first plate portion 111 is fixed to the carriage 51 containing the recording heads 52 via the frame 100F. Therefore, for detection of a foreign object S on the medium P, the foreign object detection plate 110 with the piezoelectric film sensors 120 mounted thereon need only be fixed to the carriage 51 via the first plate portion 111 and the frame 100F, eliminating the need for specific apparatus adjustment and electrical control equipment. As a result, according to the liquid ejecting apparatus 40 of this embodiment, it is possible to simplify the adjustment of the mechanical device while improving the accuracy of detection of a foreign object S.

In the liquid ejecting apparatus 40 of this embodiment, the first plate portion 111 is fixed apart from the recording heads 52 on the upstream side in the transport direction A, and the second plate portion 112, as illustrated in FIG. 3, is continuous from the first plate portion 111 toward the recording head 52. In this way, because the third plate portion 113 bent from the second plate portion 112 is positioned on the side of the recording head 52, the size of the apparatus along the transport direction A of the medium P can be reduced.

In the liquid ejecting apparatus 40 according to this embodiment, the entire area of the foreign object detection plate 110 is covered with the upper cover 100C. Therefore, in the liquid ejecting apparatus 40 of this embodiment, accidental damage of the foreign object detection plate 110 can be avoided even if a foreign object such as a pen or an ink cartridge drops onto the foreign object detection plate 110 from above the foreign object detection plate 110. In addition, the liquid ejecting apparatus 40 of this embodiment covers the medium P side of the second plate portion 112 with the sensor cover 140 further upstream than the second plate portion 112 in the transport direction A. Therefore, in the liquid ejecting apparatus 40 of this embodiment, even in the case where the foreign object S on the medium P approaches the foreign object detection plate 110, specifically the second plate portion 112, as the medium P is transported, it is possible to avoid inadvertent damage to the second plate portion 112.

As illustrated in FIG. 3, in the liquid ejecting apparatus 40 of this embodiment, the fourth plate portion 114 is bent from the third plate portion 113 toward a side away from the medium P. Therefore, according to the liquid ejecting apparatus 40 of this embodiment, even when the medium P rises at the position of the detection unit 100 when the medium P is transported in a direction opposite to the transport direction A illustrated in FIG. 3, because the medium P being reversely transported is pushed down by the fourth plate portion 114, transport jam of the medium being reversely transported can be suppressed by the fourth plate portion 114. Further, the foreign object detection plate 110 illustrated in FIG. 3 may be formed in a shape which is line symmetrically inverted with respect to the vertical line. That is, the second plate portion 112 may be continuous with and bent from the first plate portion 111 toward the upstream side of the recording head 52 in the transport direction A. In this case, a foreign object S can be guided to the third plate portion 113 by the fourth plate portion 114. In addition, in this case, the attachment position of the first plate portion 111 is not limited to the frame portion on the upstream side of the frame 100F in the transport direction A illustrated in FIG. 3, and the first plate portion 111 may be attached to the frame portion on the downstream side of the frame 100F in the transport direction A opposite to the frame portion on the upstream side of the frame 100F in the transport direction A.

In the liquid ejecting apparatus 40 of this embodiment, the third plate portion 113 is bent from the second plate portion 112 so as to be parallel with the medium P being transported. Therefore, in the liquid ejecting apparatus 40 of this embodiment, in the case where the recording head 52 housed in the carriage 51 moves relative to the medium P in the transport direction A, the possibility of damage to the medium P caused by contact of the third plate portion 113 with the medium P can be suppressed compared with the case where the third plate portion 113 is bent from the second plate portion 112 in an acute angle shape protruding downward. Further, there is no problem even if the third plate portion 113 is bent from the second plate portion 112 in a downwardly convex acute angle.

In the liquid ejecting apparatus 40 according to this embodiment, four of the detection units 100 are mounted and fixed on the carriage 51, and detection of a foreign object on the medium P having the maximum width that the recording apparatus 10 can deal with is possible. Each of the four of the detection units 100 is merely fastened to the carriage 51 via the frame 100F by bolt tightening. Therefore, in the liquid ejecting apparatus 40 of this embodiment, if any malfunction of foreign object detection occurs in any of the detection units 100, it is possible to easily replace the detection unit 100 that is malfunctioning, and the malfunction can be recovered from easily and promptly. In addition to this, in the liquid ejecting apparatus 40 of this embodiment, the foreign object detection plate 110 is fixed to the frame 100F by merely tightening the bolts in each of the four of the detection units 100. Therefore, by simply removing the upper cover 100C of the detection unit 100 which has malfunctioned and replacing the foreign object detection plate 110 of the detection unit 100 which has malfunctioned, easy and quick recovery from the malfunction is possible.

The liquid ejecting apparatus 40 of this embodiment includes four of the detection units 100 facing divided regions obtained by dividing the medium P as a target of foreign object detection along the width direction thereof. Therefore, it has the following advantages. For example, if a foreign object S exists on the right end side in the width direction (intersecting direction B) of the medium P illustrated in FIG. 2, the rightmost one of the detection units 100 in FIG. 2 facing the divided region on the right end in the width direction outputs an electric signal from the piezoelectric film sensors 120 which is larger than that of the detection unit 100 corresponding to the other divided region. The same is true when the foreign object S exists on the left end side in the width direction of the medium P illustrated in FIG. 2 or when the foreign object S exists on the right side of the width direction center or on the left side of the width direction center. Therefore, according to the liquid ejecting apparatus 40 of this embodiment, by comparing the magnitudes of the electric signals output from the four of the detection units 100, it is possible to determine at which position in the width direction of the medium P a foreign object S exists.

In the liquid ejecting apparatus 40 of this embodiment, each of the four units of the detection units 100 includes two of the piezoelectric film sensors 120 on the second plate portion 112 along the intersecting direction B (refer to FIGS. 4 and 5). Therefore, the foreign object detection accuracy is enhanced.

The invention is not limited to the above-described embodiments and modification examples, and can be realized in various configurations without departing from the gist thereof. For example, technical features in the embodiment corresponding to technical features in each application example described in the summary of the invention, other embodiments, and modification examples may be used to solve some or all of the above-mentioned problems and may be replaced or combined as appropriate in order to achieve some or all of the effects of the invention. In addition, unless technical features are described as essential in this specification, the technical features can be deleted as appropriate.

Figure 11:
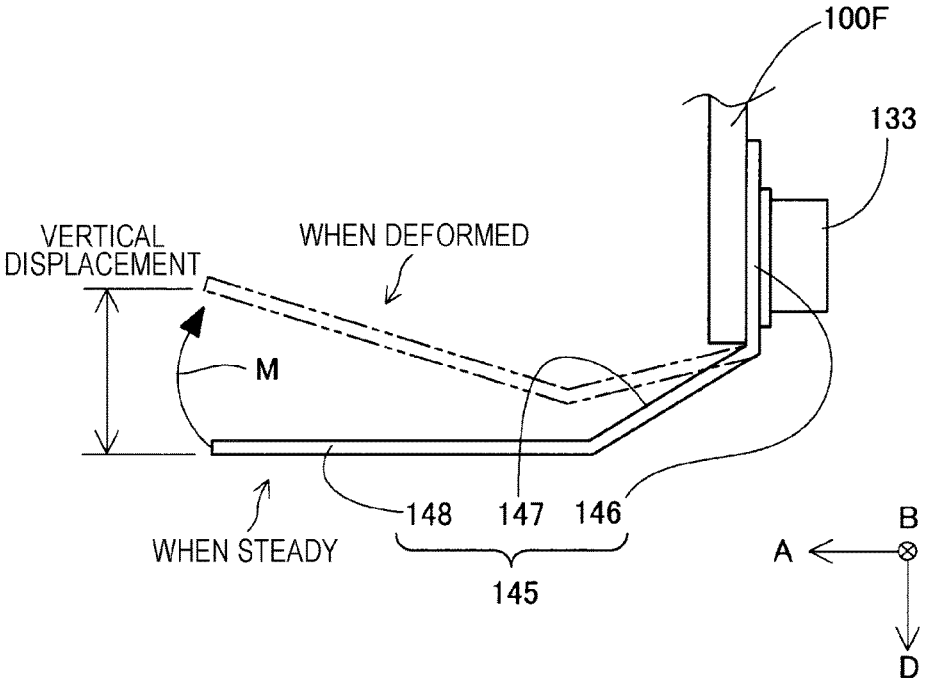
FIG. 11 is an explanatory diagram illustrating a comparison of postures of the sensor cover of a modification example when steady and when deformed.

In the embodiment described above, the sensor cover 140 is a single plate material and composed of the fixed plate portion 141, which is fixed to the frame 100F, and the cover plate portion 142, which extends substantially parallel to the medium P, bent at substantially 90° with respect to each other and continuous with each other, but the configuration is not limited thereto. FIG. 11 is an explanatory diagram illustrating a comparison of postures of a sensor cover 145 when steady and a sensor cover 145 when deformed in a modification example. The sensor cover 145 of this modification example has the same configuration as the sensor cover 140, except that the cross-sectional shape thereof is different from the sensor cover 140 already described. The sensor cover 145 is a single plate material, and includes a fixed plate portion 146, a first cover plate portion 147, and a second cover plate portion 148 that are continuous. The fixed plate portion 146 is fixed to the frame 100F over the entire surface thereof with bolts 133 and nuts (not illustrated), and holds the first cover plate portion 147 and the second cover plate portion 148, which are continuous, in a cantilever manner. The first cover plate portion 147 bends from the fixed plate portion 146 toward the recording heads 52, is continuous with the fixed plate portion 146, and is disposed diagonal to the medium P. The second cover plate portion 148 is bent and continuous from the first cover plate portion 147 and is shaped so as to extend substantially parallel to the medium P, the edge of the second cover plate portion 148 is not in contact with the first plate surface 112*a* of the second plate portion 112 and the piezoelectric film sensors 120 are covered by the first cover plate portion 147 and the second cover plate portion 148.

Figure 12:
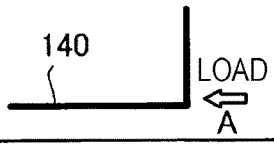
FIG. 12 is an explanatory diagram illustrating a comparison of the amount of vertical displacement of the edge of the sensor cover against a load applied to the sensor cover for different shapes of the sensor cover.
Figure 12:
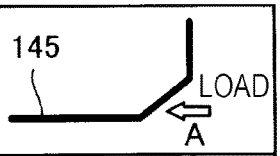

FIG. 12 is an explanatory diagram illustrating a comparison of the amount of vertical displacement of the edge of the sensor cover against a load applied to the sensor cover for different shapes of the sensor cover. Specifically, assuming a foreign object comes into contact with the sensor cover, when a load is applied to each of the lower end of the fixed plate portion 141 of the sensor cover 140 and the lower end of the first cover plate portion 147 of the sensor cover 145 in the transport direction A, the amount by which each of the edge of the cover plate portion 142 of the sensor cover 140 and the edge of the second cover plate portion 148 of the sensor cover 145 is displaced upward in the vertical direction (D direction) is measured. As illustrated in FIG. 12, it can be seen that the amount of displacement of the sensor cover 145 is about twice as large as the amount of displacement of the sensor cover 140. Therefore, it can be said that the shape of the sensor cover 145 can obtain a larger displacement amount with a smaller force than the shape of the sensor cover 140. That is, a sensor cover having the shape of the sensor cover 145 can improve the accuracy of detection of a foreign object, and further it is possible to reduce the deformation of the surface constituting member of the platen 43 due to contact with a foreign object.

In the above-described embodiment, the detection film portion 121 is formed in a rectangular shape, but it may have a shape other than a rectangular shape. In addition, for each of the detection film portions 121 provided on the second plate portion 112, the detection film portion 121 is made orthogonal to the transport direction of the medium P so that the longitudinal direction is along the width direction of the medium P body, but the detection film portion 121 may be arranged along the transport direction of the medium P or may intersect the transport direction.

In the embodiment described above, the sensor cover 140 is a plate material and deforms with a force weaker than the 0.2% proof stress of the platen mesh material serving as the surface constituting member of the platen 43 illustrated in FIG. 1 until the edge of the sensor cover 140 makes contact with the second plate portion 112; however, if the platen 43 is made of metal having no platen mesh material on its surface, the 0.2% proof stress need not be taken into consideration. In addition, when the platen mesh material is not a material not exhibiting a yielding behavior of aluminum, copper, titanium, or the like, but a material exhibiting a yielding behavior of steel or the like, the sensor cover 140 may be a plate material and deform with a weaker force than the yield stress (the minimum force causing plastic deformation) of the platen mesh material, which is the surface constituting member of the platen 43, until the edge of the sensor cover 140 comes into contact with the second plate portion 112.

In the above-described embodiment, the sensor cover 140 is formed of a conductive material and grounded; however, if the piezoelectric film sensor 120 is provided with countermeasures against static electricity, the sensor cover 140 may be made of a nonconductive material such as one formed from engineering graphics and it is not necessary for the sensor cover 140 to be grounded.

In the embodiment described above, the sensor cover 140 is a bent plate material, but the sensor cover 140 may be formed by bending a meshed or punching metal plate material.

In the above-described embodiment, the foreign object detection plate 110 is fixed to the carriage 51 via the frame 100F; however, the frame 100F may be provided on the upstream side of the recording head 52 in the transport direction separately from the carriage 51, and the foreign object detection plate 110 may be fixed to the frame 100F. That is, the foreign object detection plate 110 may be provided independently of the carriage 51. Besides this, the foreign object detection plate 110 may be fixed by housing the frame 100F itself in the carriage 51, or by forming the frame 100F from the frame body of the carriage 51.

In the embodiment described above, the first plate portion 111 is made to be separate from the recording head 52 and the second plate portion 112 is made to continue toward the recording head 52; however, the second plate portion 112 may be continued from the first plate portion 111 on the side away from the recording head 52, that is, toward the upstream side in the transport direction.

In the embodiment described above, the formed angle θ between the second plate portion 112 and the medium P is set to 25'; however, the formed angle θ between the second plate portion 112 and the medium P may be 30° or less, and the formed angle θ between the second plate portion 112 and the first plate portion 111, which is vertically fixed, may be more than 90° and not more than 120°.

In the above-described embodiment, the fourth plate portion 114 is bent from the third plate portion 113 toward the side away from the medium P; however, the fourth plate portion 114 may be omitted or the cross section of the free end of the third plate portion 113 may be arcuate.

In the above-described embodiment, the third plate portion 113 is parallel to the medium P, but may be curved toward the medium P side.

In the above-described embodiment, as illustrated in FIG. 4, the third plate portion 113 extends in the width direction of the medium P along the intersecting direction B; however, the third plate portion 113 may extend diagonal to the intersecting direction B and extend in the width direction of the medium P.

In the embodiment described above, as illustrated in FIG. 1, the detection unit 100 is provided at the end portion 51*a* of the carriage 51 on the upstream side in the transport direction A; however, the invention is not limited thereto, and in the case of using, as the recording head 52, a serial head in which nozzle rows are arranged along the transport direction A and in which the carriage 51 is made to reciprocate in the width direction of the medium P, the detection unit 100 is provided on both side surfaces of the carriage 51 in the intersecting direction B.

This application claims priority under 35 U.S.C. § 119 to Japanese Patent Application No. 2017-058632, filed Mar. 24, 2017. The entire disclosure of Japanese Patent Application No. 2017-058632 is hereby incorporated herein by reference.

What is claimed is:

1. A liquid ejecting apparatus comprising:

a supporting member that supports a medium;

a liquid ejecting unit that is arranged to face the medium and that ejects a liquid onto the medium;

a detection plate portion that is plate shaped and that undergoes strain by coming into contact with an object that can come into contact with the liquid ejecting unit with relative movement between the medium and the liquid ejecting unit;

a piezoelectric film sensor that is provided on a medium-side plate surface of the detection plate portion facing the medium and that outputs an electric signal corresponding to strain of the detection plate portion; and a sensor cover that is spaced apart from the detection plate portion and that covers the piezoelectric film sensor not to come into contact with the medium-side plate surface, wherein the piezoelectric film sensor is positioned between the sensor cover and the liquid ejecting unit in a direction of the relative movement, and the sensor cover is positioned between the supporting member and the piezoelectric film sensor in a direction in which the sensor cover faces the supporting member.

2. The liquid ejecting apparatus according to claim 1, wherein the sensor cover is elastically deformed when a force, which is smaller than a minimum force for deformation of a surface constituting member of the supporting member when a force is applied to the surface constituting member, is applied to the sensor cover and, as the sensor cover is elastically deformed, a edge of the sensor cover comes into contact with the detection plate portion.

3. The liquid ejecting apparatus according to claim 1, wherein in a case where a surface constituting member of the supporting member is made of a material exhibiting a yielding behavior, the sensor cover deforms with a weaker force than a yield stress of the surface constituting member of the supporting member and, along with the deformation, a edge of the sensor cover comes into contact with the detection plate portion, and, in a case where the surface constituting member of the supporting member is made of a material exhibiting no yielding behavior, the sensor cover deforms with a weaker force than a 0.2% proof stress of the surface constituting member of the supporting member and, along with the deformation, the edge of the sensor cover comes into contact with the detection plate portion.

4. The liquid ejecting apparatus according to claim 1, wherein in a case where the sensor cover is deformed upon contact with an object, the sensor cover comes into contact with the medium-side plate surface in a region other than a region where the piezoelectric film sensor is disposed, and induces strain of the detection plate portion.

5. The liquid ejecting apparatus according to claim 1, wherein the sensor cover does not undergo plastic deformation with a minimum force that induces strain in the detection plate portion.

6. The liquid ejecting apparatus according to claim 1, wherein the sensor cover is formed of a conductive material and grounded.

* * * * *